US009190787B2

(12) United States Patent
Chang

(10) Patent No.: US 9,190,787 B2
(45) Date of Patent: Nov. 17, 2015

(54) TRANSMISSION LINE WITH DOUBLE-CONTACT CONNECTORS

(71) Applicant: Nai-Chien Chang, New Taipei (TW)

(72) Inventor: Nai-Chien Chang, New Taipei (TW)

( * ) Notice: Subject to any disclaimer, the term of this patent is extended or adjusted under 35 U.S.C. 154(b) by 152 days.

(21) Appl. No.: 13/917,782

(22) Filed: Jun. 14, 2013

(65) Prior Publication Data

US 2014/0004749 A1 Jan. 2, 2014

(30) Foreign Application Priority Data

Jul. 2, 2012 (TW) ..... 101212769 U

(51) Int. Cl.

| | |
|---|---|
| ***H01R 13/40*** | (2006.01) |
| ***H01R 24/60*** | (2011.01) |
| ***H01R 24/62*** | (2011.01) |
| ***H01R 31/00*** | (2006.01) |
| *H01R 107/00* | (2006.01) |

(52) U.S. Cl.

CPC ..... *H01R 24/60* (2013.01); *H01R 13/40* (2013.01); *H01R 24/62* (2013.01); *H01R 31/005* (2013.01); *H01R 2107/00* (2013.01); *H01R 2201/06* (2013.01)

(58) Field of Classification Search

CPC ..... H01R 24/60

See application file for complete search history.

(56) References Cited

U.S. PATENT DOCUMENTS

| | | | | |
|---|---|---|---|---|
| 4,981,438 | A * | 1/1991 | Bekhiet | 439/76.1 |
| 5,295,843 | A * | 3/1994 | Davis et al. | 439/108 |
| 7,059,914 | B2 * | 6/2006 | Tsai | 439/660 |
| 7,074,057 | B2 * | 7/2006 | Chiran et al. | 439/92 |
| 7,572,145 | B1 * | 8/2009 | Wu | 439/607.02 |
| 2005/0014418 | A1 * | 1/2005 | Ji et al. | 439/660 |
| 2009/0111330 | A1 * | 4/2009 | Lin et al. | 439/638 |
| 2010/0087093 | A1 * | 4/2010 | Yu et al. | 439/607.01 |
| 2010/0093217 | A1 * | 4/2010 | Shi et al. | 439/607.41 |
| 2011/0028046 | A1 * | 2/2011 | Wang et al. | 439/660 |
| 2011/0306244 | A1 * | 12/2011 | Zhang et al. | 439/624 |
| 2013/0171884 | A1 * | 7/2013 | Ho | 439/660 |
| 2013/0178105 | A1 * | 7/2013 | Hsueh | 439/626 |
| 2013/0203283 | A1 * | 8/2013 | Tai et al. | 439/404 |
| 2013/0236144 | A1 * | 9/2013 | Tong et al. | 385/89 |
| 2014/0004749 | A1 * | 1/2014 | Chang | 439/660 |

* cited by examiner

*Primary Examiner* — James Harvey

(74) *Attorney, Agent, or Firm* — Chun-Ming Shih; HDLS IPR Services

(57) ABSTRACT

The present invention mainly has two double-contact connectors and a plurality of connecting lines. Each double-contact connector has an insulating member, an upper pin set and a lower pin set. A top surface of the insulating member forward extends to form an upper tongue portion, a bottom surface of the insulating member forward extends to form a lower tongue portion, the upper pin set disposes in the upper tongue portion, the lower pin set disposes in the lower tongue portion, the upper pin set and the upper tongue portion compose an upper connecting interface, the lower pin set and the lower tongue portion compose a lower connecting interface. Further, the two double-contact connectors electrically connect with the two ends of the plurality of connecting lines respectively.

12 Claims, 8 Drawing Sheets

TRANSMISSION LINE WITH DOUBLE-CONTACT CONNECTORS

BACKGROUND OF THE INVENTION

1. Field of the Invention

The present invention generally relates to a transmission line, more particularly to a transmission line that adopts double-contact connectors to be as main transmission interfaces.

2. Description of the Related Art

With advances in technology, computer has become popular in our lives, and that to cope with the rapid development of computer peripheral electronic devices, the market also developed a variety of different types of connectors so as to connect with peripheral electronic devices with different transmission interfaces.

In general, the connector has a male connector and a female connector corresponding to the male connector, and a male connector cannot plug into a female connector that is not the same connecting interface with the male connector, and a certain direction shall be followed while a male connector and a female connector plug into each other. If the direction is wrong, the plug may not work.

For Universal Serial Bus (USB) connector, each of the male USB connector and the female USB connector both has a tongue portion therein. If plugged in a wrong direction, the tongue portion in the male USB connector and the tongue portion in the female USB connector may be against to each other. For general users, such design is a foolproof design, but for other users, the application is really not flexible and inconvenient.

Accordingly, the market proposes a double-plug female connector. The design of the double-plug female connector is to dispose the tongue portion thereof in the middle of the connector, so as to divide the connector into an upper accommodating area and a lower accommodating area and dispose connecting pins in an upper layer and a lower layer respectively. So, when the front surface of the male connector plugs into the female connector, the tongue portion of the male connector may insert into the upper accommodating area and electrically connect with the conducting pins of the upper accommodating area. In addition, when the rear surface of the male connector plugs into the female connector, the tongue portion of the male connector may insert into the lower accommodating area and electrically connect with the conducting pins of the lower accommodating area. Therefore, regardless of the male connector plugging into the female connector via the front surface or the rear surface, the plug can be made and the electrical connection can be made as well.

There are two sets of conducting pins in aforementioned female connector, so that the cost is much higher than the cost of a prior female connector. However, to use a general male connector to connect with the female connector, only one set of conducting pins in the female connector are electrically connected, and therefore the female connector can only achieve a transmission rate that is the same as the prior female connector, so that it does not fit an economic effect.

SUMMARY OF THE INVENTION

The main objective of the present invention is to provide a transmission line with double-contact connectors, which is able to connect with two electronic devices that respectively have double-contact female connectors, so as to have a data transmission rate better than prior connectors.

To approach aforesaid objective, the present invention mainly has two double-contact connectors and a plurality of connecting lines. Each double-contact connector has an insulating member, an upper pin set and a lower pin set. A top surface of the insulating member forward extends to form an upper tongue portion, a bottom surface of the insulating member forward extends to form a lower tongue portion, the upper pin set disposes in the upper tongue portion, the lower pin set disposes in the lower tongue portion, the upper pin set and the upper tongue portion compose an upper connecting interface, the lower pin set and the lower tongue portion compose a lower connecting interface. Further, the two double-contact connectors electrically connect with the two ends of the plurality of connecting lines respectively.

Compared to related arts, the present invention uses the two double-contact connectors of the transmission line to respectively connect with the two double-contact female connectors of the two electronic devices. Hence, the two connecting interfaces of the two double-contact connectors are able to transmit data simultaneously, so as to have a transmission rate better than a related connector with a single interface.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objects. Please refer to FIG. 1, FIG. 2 and FIG. 3, which illustrate a schematic 3-D exploded view of a preferred embodiment of a double-contact connector of the present invention, a schematic 3-D assembled view of the preferred embodiment of the double-contact connector of the present invention and a schematic view of a transmission line of the present invention.

Figure 3:
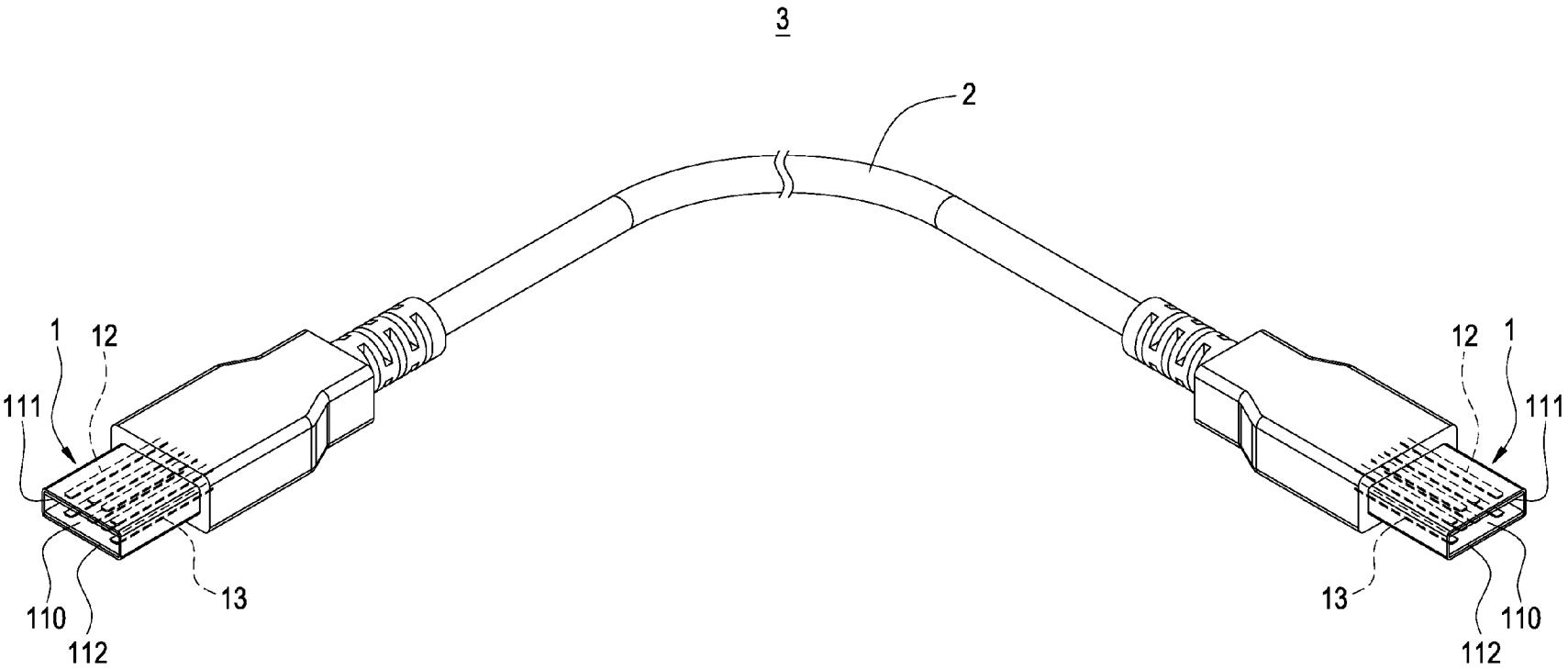
FIG. 3 illustrates a schematic view of a transmission line of the present invention.

Please refer to FIG. 3, the present invention mainly discloses a transmission line 3, which has two double-contact connectors 1 and a plurality of connecting lines 2, the two ends of each of the connecting lines 2 electrically connect with the two double-contact connectors 1 respectively. In another word, the plural connecting lines 2 electrically connect with the two double-contact connectors 1.

Figure 1:
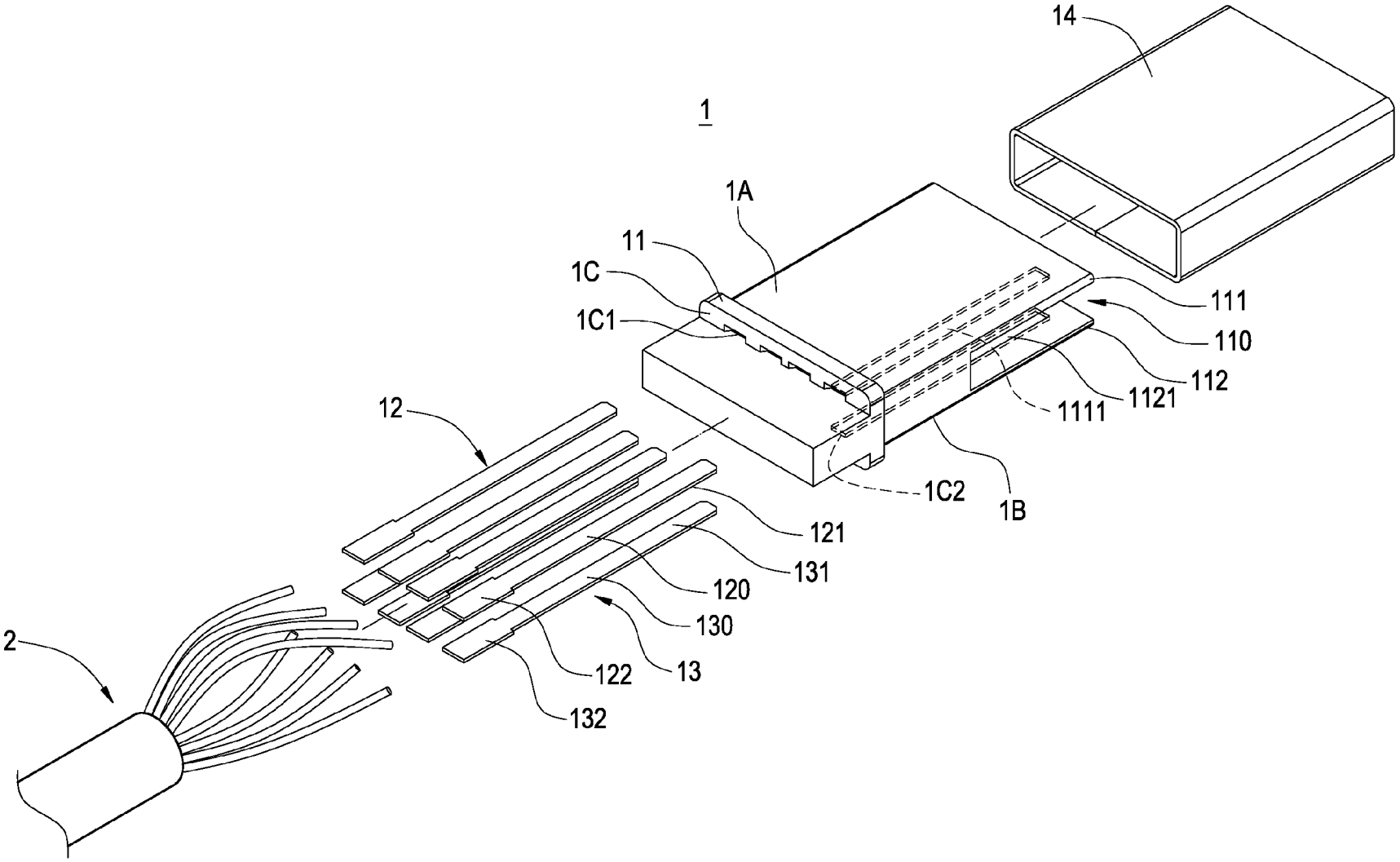
FIG. 1 illustrates a schematic 3-D exploded view of a preferred embodiment of a double-contact connector of the present invention.

Please refer to FIG. 1, each of the two double-contact connectors includes an insulating member 11, an upper pin set 12 and a lower pin set 13. The insulating member 11 mainly has a top surface 1A and a bottom surface 1B corresponding to the top surface 1A, the top surface 1A forward extends to form an upper tongue portion 111, the bottom surface 1B forward extends to form a lower tongue portion 112, and an accommodating room 110 is between the upper tongue portion 111 and the lower tongue portion 112 of each of the two double-contact connectors 1. The upper pin set 12 has a plurality of first connecting pins 120, and the first connecting pins 120 dispose in the upper tongue portion 111, so that the upper pin set 12 and the upper tongue portion 111 form an upper connecting interface. The lower pin set 13 has a plurality of second connecting pins 130, and the second connecting pins 130 dispose in the lower tongue portion 112, so that the lower pin set 13 and the lower tongue portion 112 form a lower connecting interface. It is to be noted that the number of the plural first connecting pins 120 is the same as the number of the plural second connecting pins 130, and the upper connecting interface is the same specification with the lower connecting interface.

More specifically, the upper tongue portion 111 has a plurality of upper pin slots 1111 and the lower tongue portion 112 has a plurality of lower pin slots 1121, the plural first connecting pins 120 and the plural second connecting pins 130 dispose in the plural upper pin slots 1111 and the plural lower pin slots 1121 respectively. The plural first connecting pins 120 respectively have a first conducting portion 121 and a first welding portion 122 away from the first conducting portion 121, and the plural second connecting pins 130 respectively have a second conducting portion 131 and a second welding portion 132 away from the second conducting portion 131.

Figure 2:
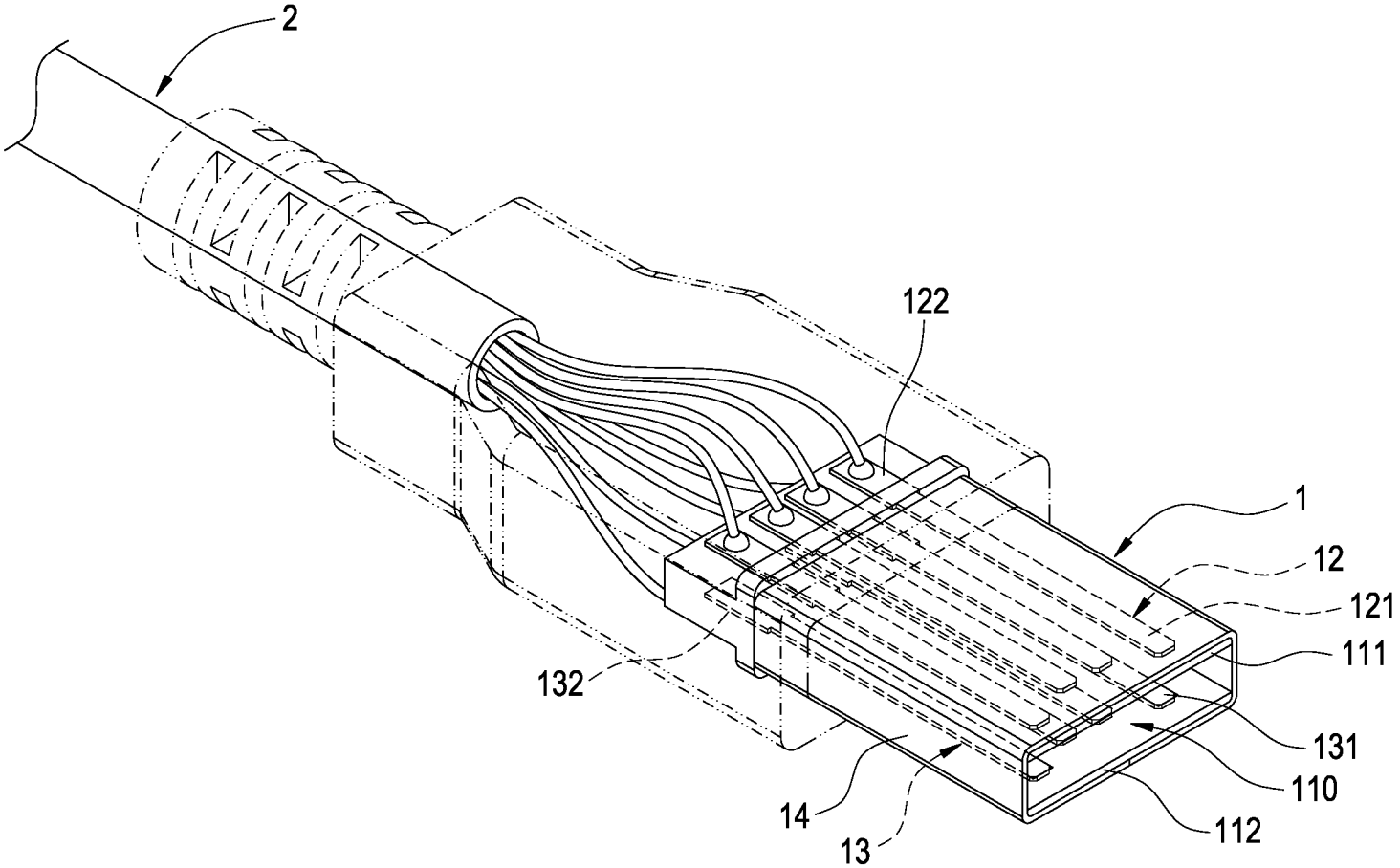
FIG. 2 illustrates a schematic 3-D assembled view of the preferred embodiment of the double-contact connector of the present invention.

The number of the plurality of connecting lines 2 is corresponding to the total number of the plural first connecting pins 120 and the plural second connecting pins 130. The plural first connecting pins 120 and the plural second connecting pins 130 respectively go through the first welding portions 122 and the second welding portions 132 in order to electrically connect with the plural connecting lines 2. As shown in FIG. 2, the upper connecting interface and the lower connecting interface are two USB 2.0 connecting interfaces, as an example, the number of the plural first connecting pins 120 is four, the number of the plural second connecting pins 130 is four, the number of the plural connecting lines 2 is eight. The two ends of each of the plural connecting lines 2 respectively connect with the double-contact connectors 1 and also electrically connect with the first connecting pins 120 and the second connecting pins 130 of the double-contact connectors 1. More specifically, the two ends electrically connect with the first welding portions 122 and the second welding portions 132 of the first connecting pins 120 and the second connecting pins 130.

Above is a preferred embodiment of the present invention. For another preferred embodiment, the upper connecting interface and the lower connecting interface are two USB 3.0 connecting interfaces, as an example, the number of the plural first connecting pins 120 is nine, the number of the plural second connecting pins 130 is nine, the number of the plural connecting lines 2 is eighteen.

As shown in FIG. 1, the insulating member 11 has a back surface (1C) adjacent to the top surface 1A and the bottom surface 1B, the back surface 1C has a plurality of upper opens 1C1 and a plurality of lower opens 1C2, the first welding portions 122 of the first connecting pins 120 go through the plural upper opens 1C1 in order to electrically connect with the plural connecting lines 2, and the second welding portions 132 of the second connecting pins 130 go through the plural lower opens 1C2 in order to electrically connect with the plural connecting lines 2. Above USB 2.0 as an example, the first welding portions 122 electrically connect with four of the plural connecting lines 2, and the second welding portions 132 electrically connect with another four of the plural connecting lines 2.

As shown in FIG. 1 again, the double-contact connectors 1 further has a metal case 14 in order to wrap around the insulating member 11, the upper pin set 12 and the lower pin set 13 for metallic shielding.

Figure 4:
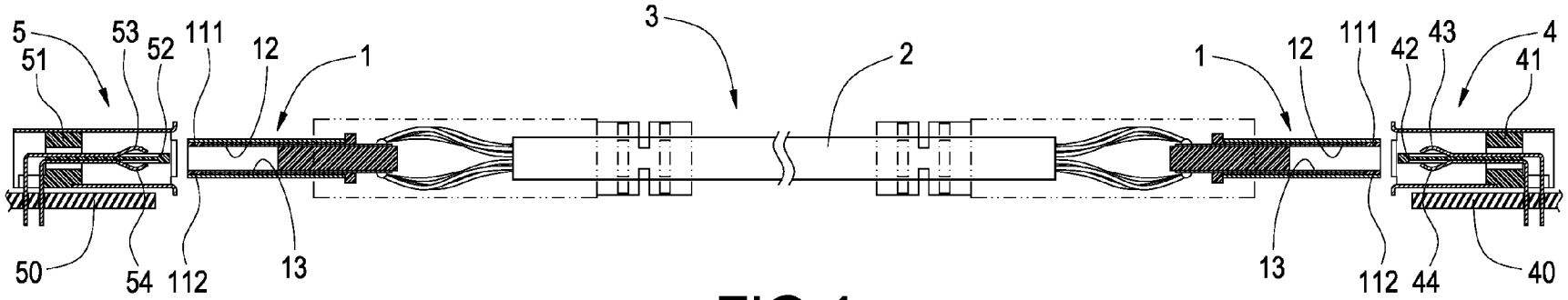
FIG. 4 illustrates a schematic view of the transmission line, before connection, of a preferred embodiment of the present invention.
Figure 5:
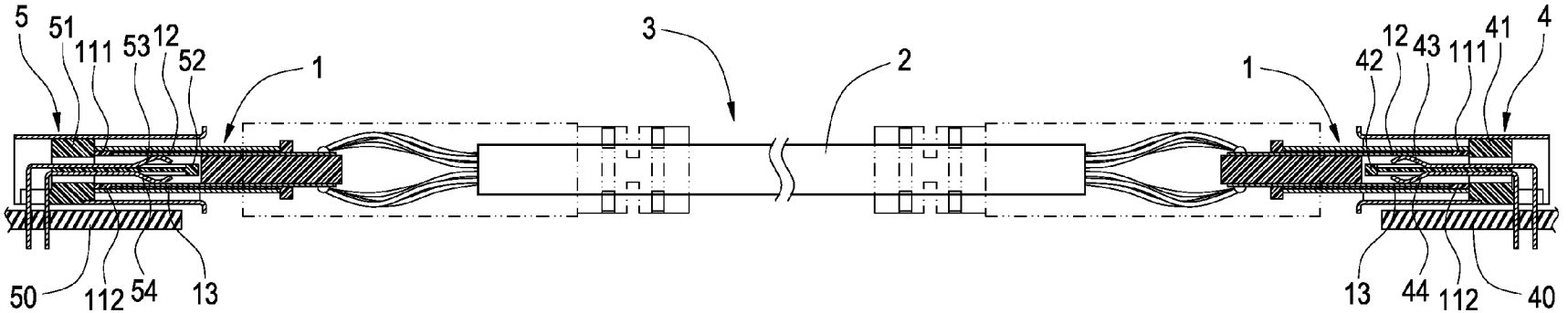
FIG. 5 illustrates a schematic view of the transmission line, after connection, of the preferred embodiment of the present invention.
Figure 6:
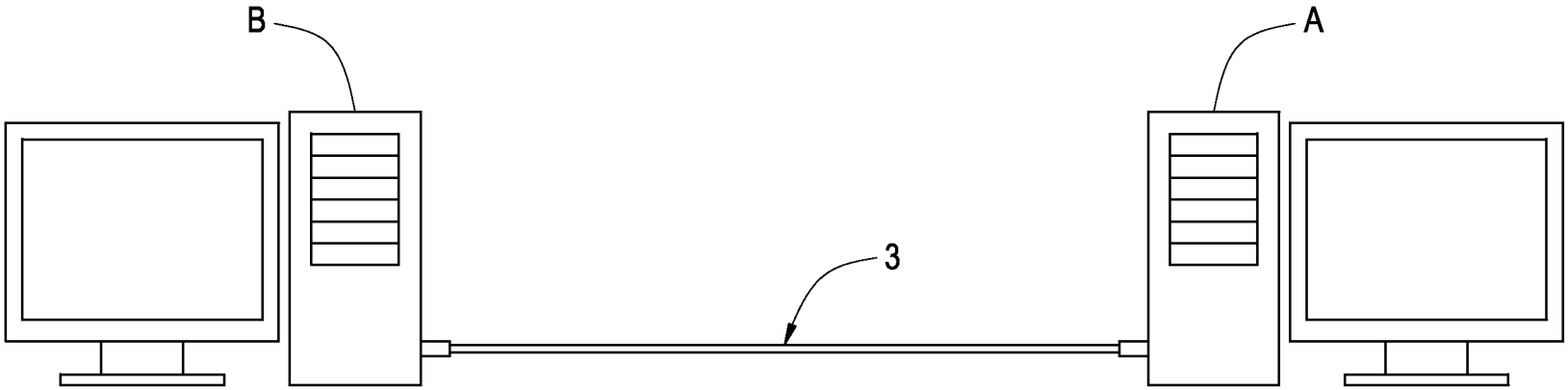
FIG. 6 illustrates a schematic view of applying the transmission line of the preferred embodiment of the present invention.

Please simultaneously refer to FIG. 4, FIG. 5 and FIG. 6, which illustrate a schematic view of the transmission line, before connection, of a preferred embodiment of the present invention, a schematic view of the transmission line, after connection, of the preferred embodiment of the present invention, and a schematic view of applying the transmission line of the preferred embodiment of the present invention. As shown in FIG. 6, a transmission line 3 uses the two double-contact connectors 1 to electrically connect with two electronic devices A and B so as to proceed the data transmission between the two electronic devices A and B. More specifically, the two electronic devices A and B respectively have two main boards 40 and 50, and the two main boards 40 and 50 are respectively disposed two double-contact female connectors 4 and 5 (female connectors 4 and 5 will be the abbreviations as bellow). The transmission line 3 connects with the female connector 4 of the electronic device A via the double-contact connector 1, and through the other double-connect connector 1, the transmission line 3 connects with the female connector 5 of the electronic device B, then the two double-contact connectors 1 are connected to each other by the plural connecting lines 2.

As shown in FIG. 4, the female connectors 4 and 5 respectively have insulating members 41 and 51, the centers of the insulating members 41 and 51 forward extend to form two tongue portions 42 and 52. The female connectors 4 and 5 respectively have plural first conducting pins 43 and 53 and plural second conducting pins 44 and 54, wherein the plural first conducting pins 43 and 53 and the plural second conducting pins 44 and 54 respectively dispose on the upper layers and the lower layers of the tongue portions 42 and 52.

While the two double-contact connectors 1 of the transmission line 3 respectively plug into the female connectors 4 and 5, the accommodating rooms 110 contain the tongue portions 42 and 52 of the female connectors 4 and 5, and the upper pin sets 12 electrically connect with the plural first conducting pins 43 and 53, and the lower pin sets 13 electrically connect with the plural second conducting pins 44 and 54. For the embodiment, if the female connector 4 supports that the two sets of the first conducting pins 43 and the second conducting pins 44 are simultaneously used, and the female connector 5 supports that the two sets of the first conducting pins 53 and the second conducting pins 54 are simultaneously used as well, hence the first conducting pins 43 and 53 are able to connect with the upper pin sets 12 of the two double-contact connectors 1 of the transmission line 3 respectively in order to build a first data transmission channel; the second conducting pins 44 and 54 are able to connect with the lower pin sets 13 of the two double-contact connectors 1 of the transmission line 3 respectively in order to build a second data transmission channel. Therefore, through the transmission line 3 of the present invention, the transmission rate of the transmission line 3 is twice as fast as the transmission rate of a general transmission line.

Figure 7:
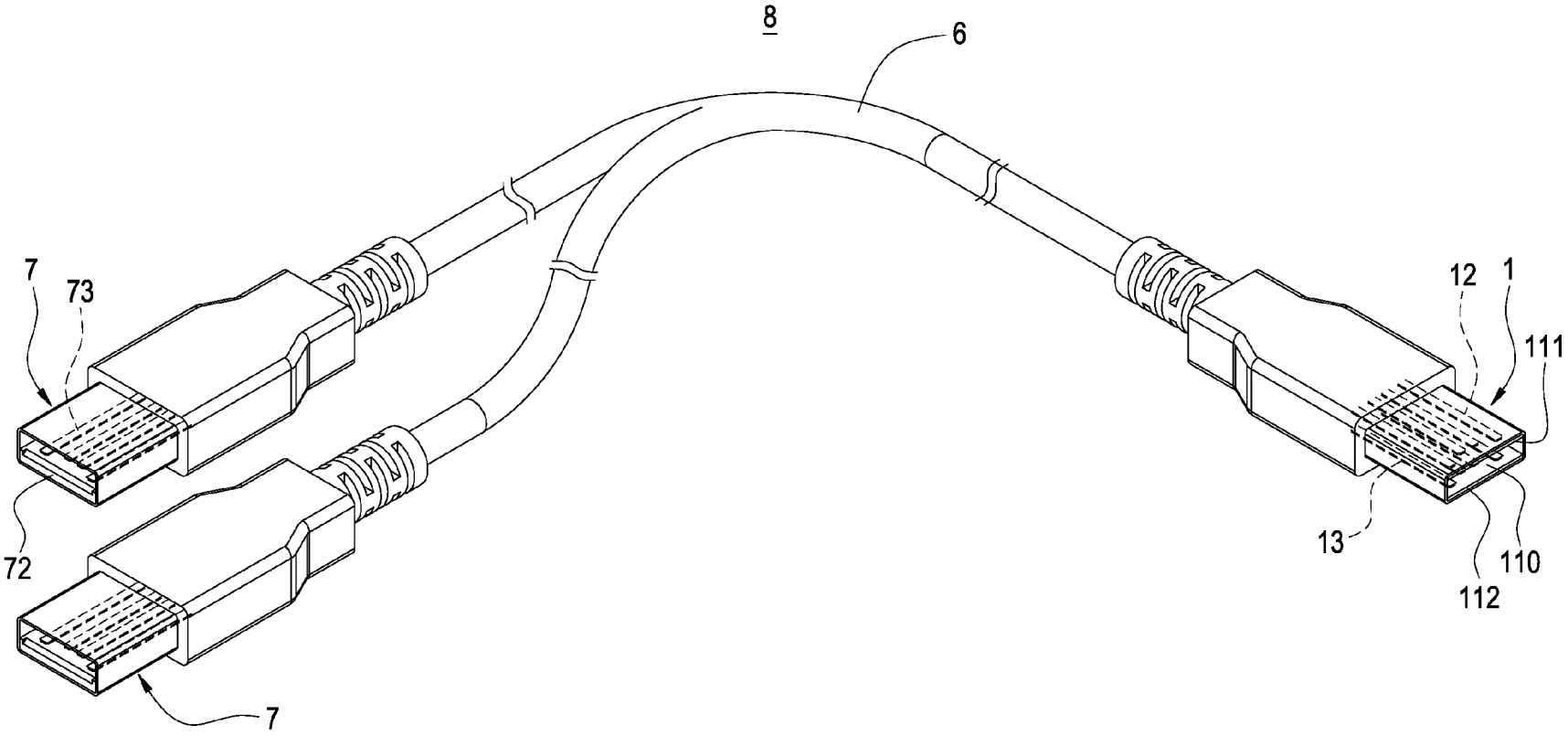
FIG. 7 illustrates a schematic view of a transmission line of another preferred embodiment of the present invention.

Please refer to FIG. 7, which illustrates a schematic view of a transmission line of another preferred embodiment of the present invention. The embodiment mainly discloses another kind of transmission line 8. The transmission line 8 has plural connecting lines 6, one end of the plural connecting lines 6 electrically connects with above double-contact connector 1, another end is divided into a first channel and a second channel so as to respectively connect with two male connectors 7. More specifically, the specifications of the two male connectors 7 are corresponding to the specifications of the upper connecting interface and the lower connecting interface of the double-contact connector 1. As shown in FIG. 7, if both the upper connecting interface and the lower connecting interface are USB 2.0 connecting interfaces, the two male connector 7 may be USB 2.0 male connectors. For another embodiment, if both the upper connecting interface and the lower connecting interface are USB 3.0 connecting interfaces, the two male connector 7 may be USB 3.0 male connectors.

Please be noted, the number of the plural connecting lines 6 is corresponding to the total number of the plural first connecting pins 120 and the plural second connecting pins 130. If both the upper connecting interface and the lower connecting interface are USB 2.0 connecting interfaces, the numbers of the plural first connecting pins 120 and the plural second connecting pins 130 are four respectively, the number of the plural connecting lines 6 is eight, wherein four of one end electrically connecting with the plural first connecting pins 120 belong to the first channel, another end is to connect with one of the two male connector 7, another four of one end electrically connecting with the plural second connecting pins 130 belong to the second channel, another end is to connect with the other one of the two male connector 7. Further, If both the upper connecting interface and the lower connecting interface are USB 3.0 connecting interfaces, the numbers of the plural first connecting pins 120 and the plural second connecting pins 130 are nine respectively, the number of the plural connecting lines 6 is eighteen, wherein nine of one end electrically connecting with the plural first connecting pins 120 belong to the first channel, another nine of one end electrically connecting with the plural second connecting pins 130 belong to the second channel.

Figure 8:
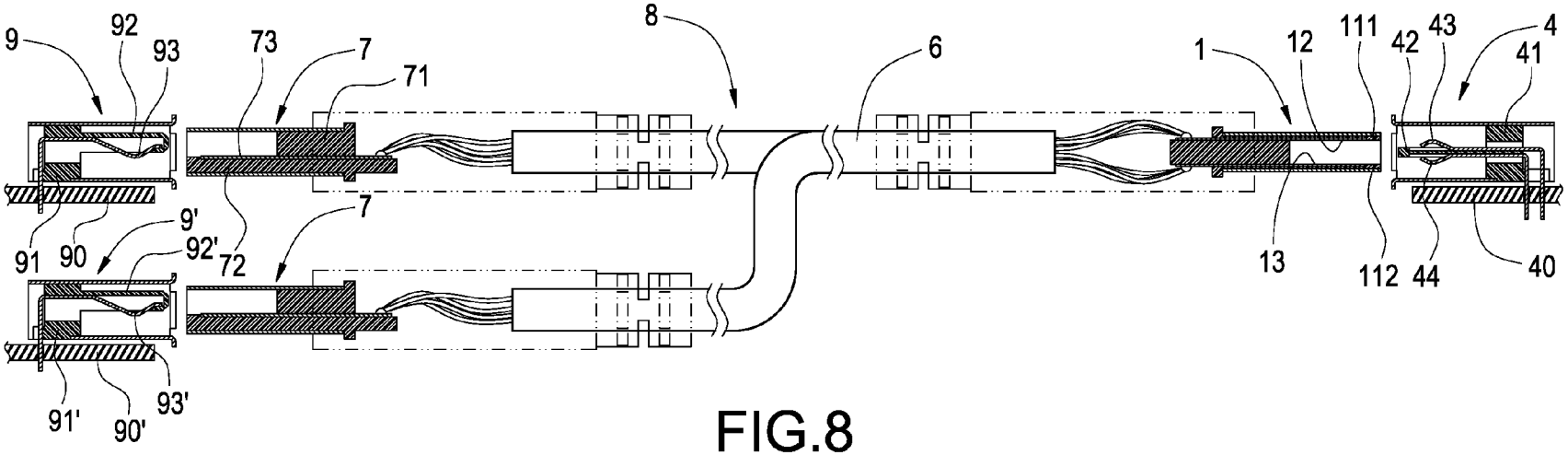
FIG. 8 illustrates a schematic view of the transmission line, before connection, of another preferred embodiment of the present invention.
Figure 9:
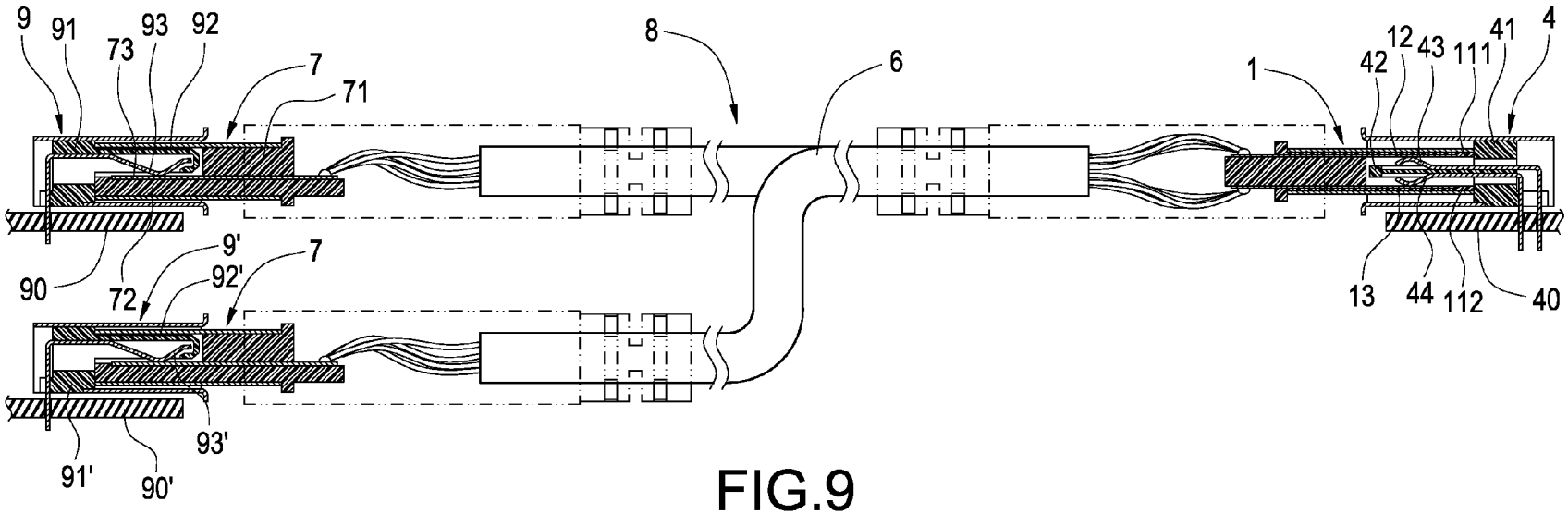
FIG. 9 illustrates a schematic view of the transmission line, after connection, of the preferred embodiment of the present invention.
Figure 10:
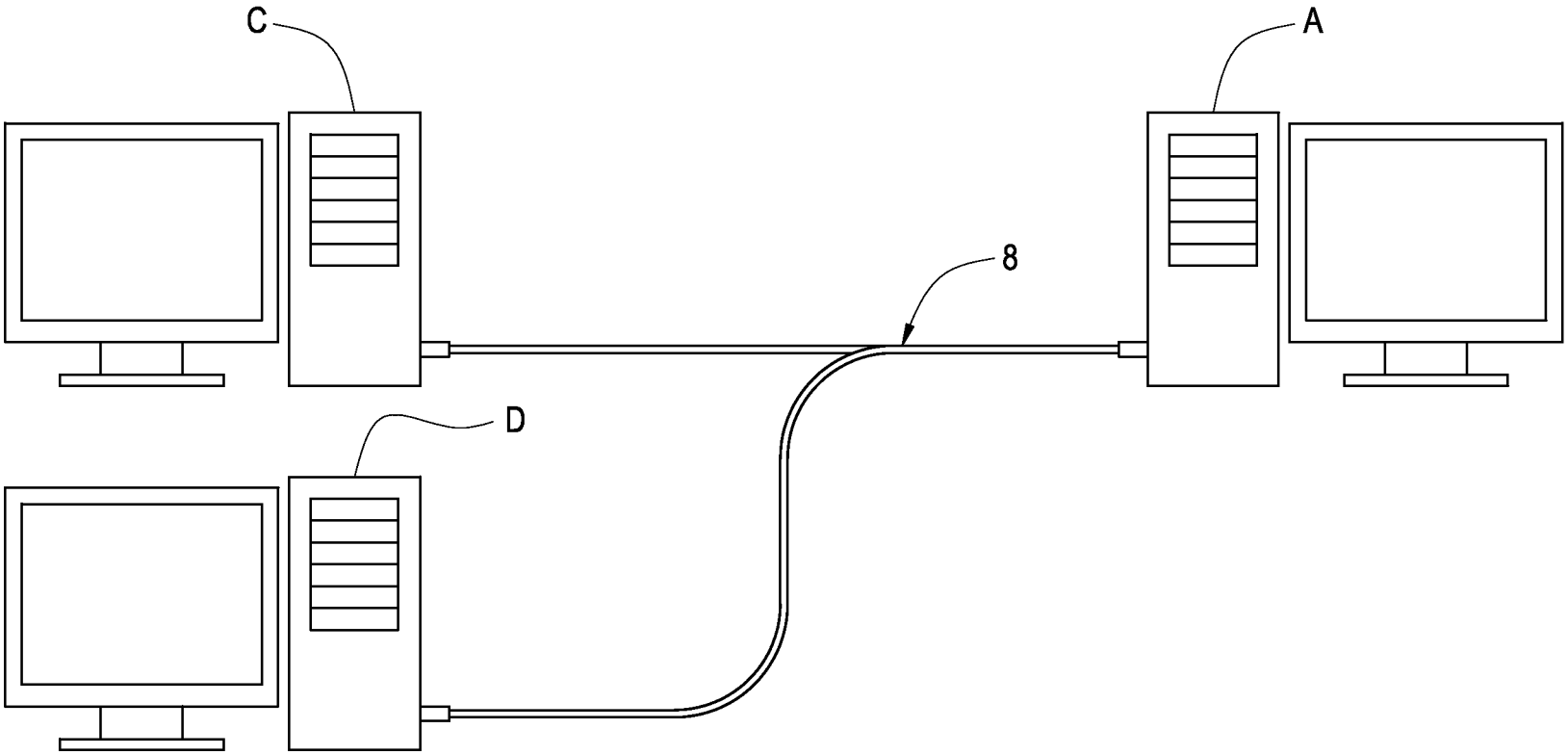
FIG. 10 illustrates a schematic view of applying the transmission line of the preferred embodiment of the present invention.

Please simultaneously refer to FIG. 8, FIG. 9 and FIG. 10, which illustrate a schematic view of the transmission line, before connection, of another preferred embodiment of the present invention, a schematic view of the transmission line, after connection, of the preferred embodiment of the present invention, and a schematic view of applying the transmission line of the preferred embodiment of the present invention. As shown in FIG. 10, via the transmission line 8 of the present invention, the electronic device A may simultaneously connect with two electronic devices C and D, therefore, data transmission can be proceeded among the three electronic devices A, C and D.

As shown in FIG. 8 and FIG. 9, the two electronic devices C and D has two main boards 90 and 90' respectively, and the two main boards 90 and 90' respectively dispose two female connectors 9 and 9', the specifications of the two female connectors 9 and 9' are corresponding to the specifications of the two male connectors 7 of the transmission line 8 (as shown in FIG. 7, the female connectors 9 and 9', USB 2.0 interfaces, respectively connect with the two male connectors 7, but not limited). Each of the two male connectors 7 has an insulating member 71, and the end surface of the insulating member 71 forward extends to form a tongue portion 72. The male connectors 7 has plural conducting pins 73 that are disposed in the tongue portion 72. One end of the plural connecting lines 6 electrically connects with the double-contact connector 1, and another end is divided into the first channel and the second channel, the first channel and the second channel respectively connect with the plural conducting pins 73 of the two male connectors 7.

The two female connectors 9 and 9' respectively have two insulating members 91 and 91', the front ends of the two insulating members 91 and 91' forward extend to form two tongue portions 92 and 92'. The female connectors 9 and 9' respectively have plural conducting pins 93 and 93' that dispose on the two tongue portions 92 and 92'. The transmission line 8 of the present invention is to connect with the female connector 4 of the electronic device A via the double-contact connector 1 and to respectively connect with the female connectors 9 and 9' of the two electronic devices C and D via the two male connectors 7.

More specifically, if the female connector 4 supports that the two sets of conducting pins 43 and 44 can be used simultaneously, the plural first conducting pins 43 can connect with the plural connecting lines 6 (if it is an USB 2.0 connecting interface, the plural connecting lines 6 are four therein; if it is an USB 3.0 connecting interface, the plural connecting lines 6 are nine therein) belonging to the first channel via the upper pin set 12 of the double-contact connector 1, further to connect with the electronic device C via one of the male connectors 7. Further, the plural second conducting pins 44 can connect with the plural connecting lines 6 belonging to the second channel via the lower pin set 13 of the double-contact connector 1, further to connect with the electronic device D via another one of the male connectors 7. Therefore, the electronic device A can connect with the transmission line 8 via the female connector 4 in order to transmit data to the electronic devices C and D simultaneously.

As aforesaid, the transmission line 8 of the present invention mainly transmits the same of different data to the two different electronic devices C and D from the electronic device A at the same time, so as to improve convenience.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A transmission line with double-contact connectors comprising:

two double-contact connectors, each comprising:

an insulating member, having a top surface and a bottom surface corresponding to the top surface, the top surface forward extending to form an upper tongue portion, the bottom surface forward extending to form a lower tongue portion;

an upper pin set, having a plurality of first connecting pins and disposing in the upper tongue portion, so that the upper pin set and the upper tongue portion form an upper connecting interface; and a lower pin set, having a plurality of second connecting pins and disposing in the lower tongue portion, so that the lower pin set and the lower tongue portion form a lower connecting interface; and a plurality of connecting lines, electrically connecting with the two double-contact connectors;

wherein the number of the plurality of connecting lines is corresponding to the total number of the plural first connecting pins and the plural second connecting pins, and wherein the upper connecting interface and the lower connecting interface are two USB (universal serial bus) connecting interfaces; and wherein the upper connecting interface and the lower connecting interface build a first USB data transmission channel and a second USB data transmission channel, respectively, and the first and the second USB data transmission channels can work simultaneously to double the USB data transmission rate.

2. The transmission line with the double-contact connectors according to claim 1, wherein the upper tongue portion of each of the two double-contact connectors has a plurality of upper pin slots and the lower tongue portion of each of the two double-contact connectors has a plurality of lower pin slots, the plural first connecting pins disposing in the plural upper pin slots respectively, the plural second connecting pins disposing in the plural lower pin slots respectively.

3. The transmission line with the double-contact connectors according to claim 2, wherein an accommodating room is between the upper tongue portion and the lower tongue portion of each of the two double-contact connectors, the accommodating room containing a tongue portion of an external female connector while the double-contact connector electrically connects with the external female connector.

4. The transmission line with the double-contact connectors according to claim 3, wherein the front end and the rear end of the plural first connecting pins of each of the two double-contact connectors have a first conducting portion and a first welding portion respectively, and the front end and the rear end of the plural second connecting pins of each of the two double-contact connectors have a second conducting portion and a second welding portion respectively, the first conducting portion going through the plural upper pin slots in order to expose in the accommodating room, the second conducting portion going through the plural lower pin slots in order to expose in the accommodating room, the first welding portion and the second welding portion connecting with the two ends of the plural connecting lines respectively.

5. The transmission line with the double-contact connectors according to claim 4, wherein the insulating member of each of the two double-contact connectors has a back surface adjacent to the top surface and the bottom surface, the back surface having a plurality of upper opens and a plurality of lower opens, the first welding portion and the second welding portion respectively going through the plural upper opens and the plural lower opens in order to extend out the back surface for electrically connecting with the plural connecting lines.

6. The transmission line with the double-contact connectors according to claim 1, wherein each of the two double-contact connectors has a metal case in order to wrap around the insulating member, the upper pin set and the lower pin set for metallic shielding.

7. A transmission line with a double-contact connector comprising:

a double-contact connector, comprising:

an insulating member, having a top surface and a bottom surface corresponding to the top surface, the top surface forward extending to form an upper tongue portion, the bottom surface forward extending to form a lower tongue portion;

an upper pin set, having a plurality of first connecting pins and disposing in the upper tongue portion, so that the upper pin set and the upper tongue portion form an upper connecting interface; and a lower pin set, having a plurality of second connecting pins and disposing in the lower tongue portion, so that the lower pin set and the lower tongue portion form a lower connecting interface;

two male connectors, specifications of the two male connectors being corresponding to the specifications of the upper connecting interface and the lower connecting interface respectively; and a plurality of connecting lines, one end of each of the plural connecting lines electrically connecting with the double-contact connector, another end of each of the plural connecting lines having a first USB data transmission channel and a second USB data transmission channel in order to electrically connect with the two male connectors;

wherein the numbers of the pins of the two male connectors are corresponding to the number of the plural first connecting pins and the number of the plural second connecting pins respectively, the number of the plural connecting lines being corresponding to the total number of the plural first connecting pins and the plural second connecting pins;

wherein the upper connecting interface, the lower connecting interface, and the two male connectors are USB (universal serial bus) connecting interfaces, respectively; and wherein the first USB data transmission channel is established between the upper connecting interface and one of the two male connectors, and the second USB data transmission channel is established between the lower connecting interface and the other one of the two male connectors; the first and the second USB data transmission channels can simultaneously transfer data with the two male connectors, respectively.

8. The transmission line with the double-contact connector according to claim 7, wherein the upper tongue portion of the double-contact connectors has a plurality of upper pin slots and the lower tongue portion of the two double-contact connectors has a plurality of lower pin slots, the plural first connecting pins disposing in the plural upper pin slots respectively, the plural second connecting pins disposing in the plural lower pin slots respectively.

9. The transmission line with the double-contact connector according to claim 8, wherein an accommodating room is between the upper tongue portion and the lower tongue portion of the two double-contact connectors, the accommodating room containing a tongue portion of an external female connector while the double-contact connector (1) electrically connects with the external female connector (9).

10. The transmission line with the double-contact connector according to claim 9, wherein the front end and the rear end of the plural first connecting pins of the double-contact connector have a first conducting portion and a first welding portion respectively, and the front end and the rear end of the plural second connecting pins of the double-contact connector have a second conducting portion and a second welding portion respectively, the first conducting portion going through the plural upper pin slots in order to expose in the accommodating room, the second conducting portion going through the plural lower pin slots in order to expose in the accommodating room, the first welding portion and the second welding portion connecting with the one end of the plural connecting lines respectively.

11. The transmission line with the double-contact connector according to claim 10, wherein the insulating member of the double-contact connector has a back surface adjacent to the top surface and the bottom surface, the back surface having a plurality of upper opens and a plurality of lower opens, the first welding portion and the second welding portion respectively going through the plural upper opens and the plural lower opens in order to extend out the back surface for electrically connecting with the plural connecting lines.

12. The transmission line with the double-contact connector according to claim 7, wherein the two double-contact connector has a metal case in order to wrap around the insulating member, the upper pin set and the lower pin set for metallic shielding.

* * * * *